United States Patent [19]

Clark et al.

[11] Patent Number: 4,703,731

[45] Date of Patent: Nov. 3, 1987

[54] SPARK TIMING CONTROL FOR MARINE PROPULSION DEVICES

[75] Inventors: Danny L. Clark, Kenosha, Wis.; Robert W. Woodard, Waukegan; Philip A. Zorc, Chicago, both of Ill.

[73] Assignee: Outboard Marine Corporation, Waukegan, Ill.

[21] Appl. No.: 851,954

[22] Filed: Apr. 14, 1986

[51] Int. Cl.[4] ..... F02D 37/00

[52] U.S. Cl. ..... 123/413; 192/8 R

[58] Field of Search ..... 123/413, 99; 192/8

[56] References Cited

U.S. PATENT DOCUMENTS

| | | | |
|---|---|---|---|
| 1,146,317 | 7/1915 | Favary | 192/8 |
| 1,211,550 | 1/1917 | Cuff | 192/8 |
| 1,529,248 | 3/1925 | Greene, et al. | 192/8 |
| 1,886,566 | 11/1932 | Mallory | 123/413 |
| 2,858,819 | 11/1958 | Pollari | 123/99 |
| 2,890,689 | 6/1959 | Alexander | 123/413 |
| 2,906,251 | 9/1959 | Soder | 123/413 |
| 3,769,949 | 11/1973 | Elingsen | 123/99 |
| 4,071,002 | 1/1978 | Frahm | 123/99 |
| 4,622,938 | 11/1986 | Wenstadt | 123/413 |

*Primary Examiner*—Ronald B. Cox

*Attorney, Agent, or Firm*—Michael, Best & Friedrich

[57] ABSTRACT

A marine propulsion device comprising a mounting assembly adapted to be mounted on the transom of a boat, and a propulsion unit mounted on the mounting assembly for pivotal movement relative thereto about a generally vertical steering axis, the propulsion unit including a rotatably mounted propeller, and an internal combustion engine drivingly connected to the propeller, the engine comprising an engine block, a timing member mounted on the engine block for movement relative thereto in opposite advance and retarding the spark timing of the engine, a releasable lock for preventing movement of the timing member in the retard direction, and an operator actuatable mechanism for releasing the lock and moving the timing member in the retard direction, and for moving the timing member in the advance direction.

44 Claims, 9 Drawing Figures

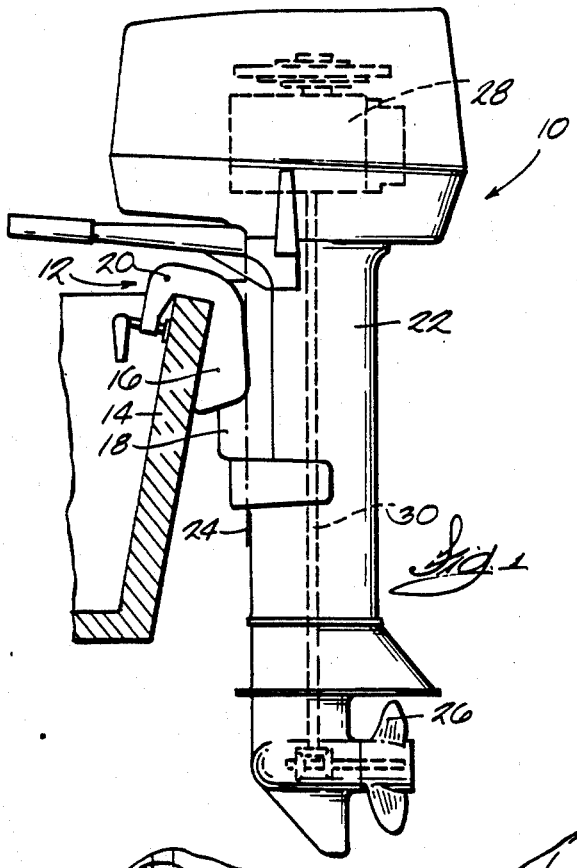
Fig. 1
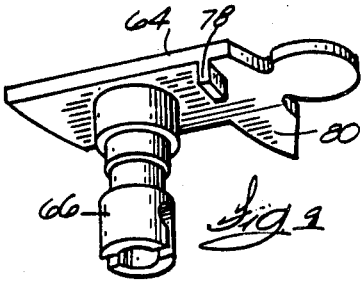
Fig. 2
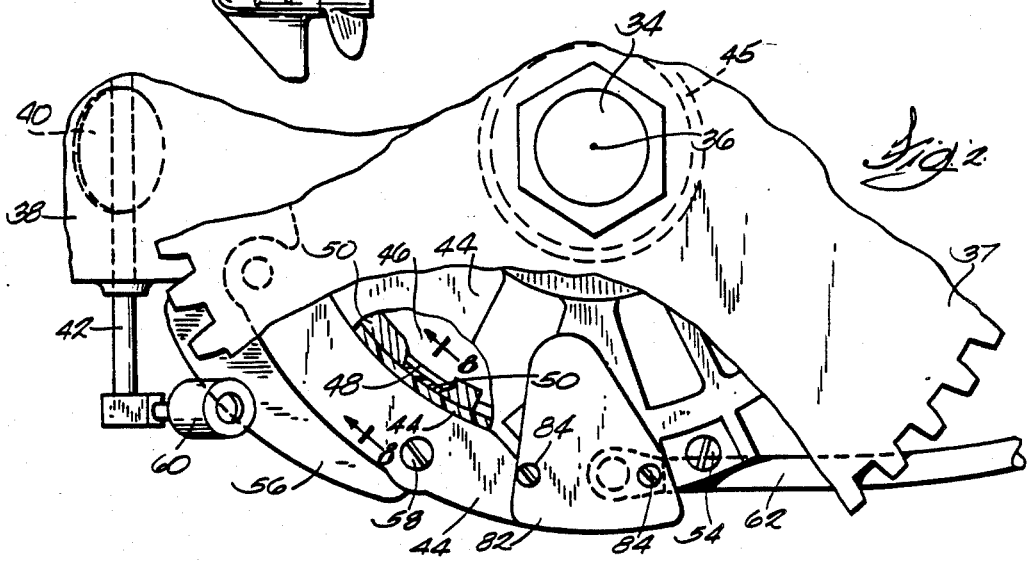
Fig. 3
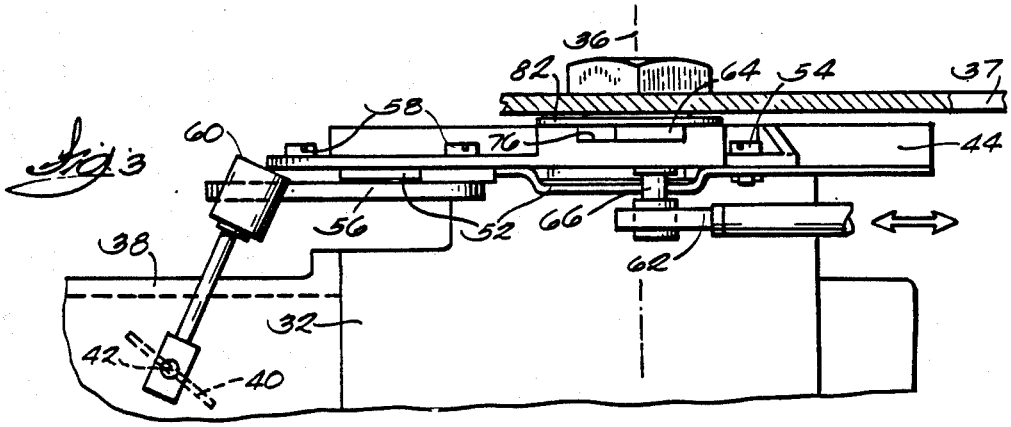

SPARK TIMING CONTROL FOR MARINE PROPULSION DEVICES

BACKGROUND OF THE INVENTION

The invention relates to marine propulsion devices, and, more particularly, to means for controlling the spark timing in marine propulsion device internal combustion engines.

In marine propulsion device internal combustion engines, the timing plate is typically mounted for rotation about the crankshaft axis to control the spark timing of the engine. In many cases, rotation of the timing plate also controls the throttle by way of a throttle cam which is mounted on the timing plate and a throttle cam roller which engages the throttle cam and which moves the throttle plate in response to movement of the throttle cam. Such an arrangement is disclosed in U.S. Soder Pat. No. 2,906,251, issued Sept. 29, 1959.

The throttle plate is normally biased toward the closed position, and the force biasing the throttle plate toward the closed position acts through the throttle cam roller and the throttle cam to exert on the timing plate a torque biasing the timing plate in the direction closing the throttle plate. Failure to counter this torque may allow the throttle plate to close during engine operation.

It is known to counter this torque either with a detent mechanism or by creating excessive frictional drag that will hold the timing plate in place. Both of these systems resist movement of the timing plate in both directions, although the torque only acts in one direction. Known detent mechanisms must be overcome by the operator in order to move the control handle. These mechanisms also have a rough feel, and they only permit the operator to set the throttle in discrete positions. Known frictional drag systems permit the operator to set the throttle at any position within a continuous range of positions, but the operator must overcome the frictional drag in order to alter the throttle setting.

Attention is directed to the following U.S. patents:

| | | |
|---|---|---|
| Favary | 1,146,317 | July 13, 1915 |
| Cuff | 1,211,550 | Jan. 9, 1917 |
| Greene, et al. | 1,529,248 | March 10, 1925 |
| Mallory | 1,886,566 | Nov. 8, 1932 |
| Pollari | 2,858,819 | Nov. 4, 1958 |
| Elingsen | 3,769,949 | Nov. 6, 1973 |
| Frahm | 4,071,002 | Jan. 31, 1978 |

SUMMARY OF THE INVENTION

The invention provides a marine propulsion device comprising a mounting assembly adapted to be mounted on the transom of a boat, and a propulsion unit mounted on the mounting assembly for pivotal movement relative thereto about a generally vertical steering axis, the propulsion unit including a rotatably mounted propeller, and an internal combustion engine drivingly connected to the propeller, the engine comprising an engine block, a timing member mounted on the engine block for movement relative thereto in opposite advance and retard directions for respectively advancing and retarding the spark timing of the engine, releasable locking means for preventing movement of the timing member in one of the directions, and operator actuatable means for releasing the locking means and moving the timing member in the one direction, and for moving the timing member in the other direction.

In one embodiment, the operator actuatable means is operable for moving the timing member to any position within a continuous range of positions.

In one embodiment, the one direction is the retard direction.

In one embodiment, the operator actuatable means includes an operator actuatable mechanism movable in opposite first and second directions, and means operable on the timing member for moving the timing member in the advance direction in response to movement of the mechanism in the first direction, and for releasing the locking means and moving the timing member in the retard direction in response to movement of the mechanism in the second direction.

In one embodiment, the means operable on the timing member includes a lever movably mounted on the timing member, means for releasing the locking means and causing movement of the timing member in the retard direction in response to movement of the lever in the retard direction, and for causing movement of the timing member in the advance direction in response to movement of the lever in the advance direction, and means connecting the lever to the mechanism for causing movement of the lever in the advance direction in response to movement of mechanism in the first direction, and for causing movement of the lever in the retard direction in response to movement of the mechanism in the second direction.

In one embodiment, the first and second directions are respectively the same as the advance and retard directions, and the means connecting the lever to the mechanism causes common movement of the lever and the mechanism.

In one embodiment, the mechanism is a push-pull cable.

In one embodiment, the marine propulsion device further comprises a first surface fixed relative to the engine block and extending in the advance and retard directions, the timing member includes a second surface closely spaced from the first surface with the first and second surfaces converging in the advance direction, and the locking means includes the first and second surfaces, a roller located between the first and second surfaces, and means biasing the roller in the advance direction relative to the first and second surfaces for wedging the roller between the first and second surfaces so as to prevent movement of the timing member in the retard direction.

In one embodiment, the releasing means includes means for moving the roller, in response to movement of the lever in the retard direction relative to the timing member, in the retard direction against the force of the biasing means and relative to the first and second surfaces so as to permit movement of the timing member in the retard direction.

In one embodiment, the lever is mounted on the timing member for rotation relative thereto about an axis, the mechanism is connected to the lever at a point spaced from the axis, the means biasing the roller in the advance direction exerts a force on the roller, and the means for moving the roller includes, on the lever, a projection located intermediate the point and the axis, whereby the force required from the mechanism to move the lever in the retard direction relative to the timing member is less than the force exerted by the biasing means.

In one embodiment, the timing member is mounted on the engine block for rotation about an axis, the advance and retard directions are opposite directions of rotation about the axis, the engine further comprises a plate fixedly mounted on the engine block, the plate including an arcuate outer surface forming at least part of a circle centered on the axis, the first surface is the arcuate surface, and the second surface is spaced radially outwardly of the first surface.

The invention also provides an internal combustion engine as described above.

A principal feature of the invention is the provision of the above-described locking means and operator actuatable means for moving the timing member to control the spark timing of the engine. One advantage of this arrangement is that it prevents movement of the timing member solely in one direction in the absence of operator actuation. Preferably, this arrangement prevents movement of the timing member in the retard direction in the absence of operator actuation, but does not inhibit movement of the timing member in the advance direction. Another advantage of this arrangement is that it is operable for moving the timing member to any position within a continuous range of positions, as opposed to being operable for moving the timing member only to discrete positions, as is the case with the above-described detent mechanisms.

Other features and advantage of the invention will become apparent to those skilled in the art upon review of the following detailed description, claims and drawings.

DESCRIPTION OF THE DRAWINGS

FIG. 1 is a side elevational view of a marine propulsion device which embodies various of the features of the invention and which includes an internal combustion engine including a flywheel, a timing member, and operator actuatable means for moving the timing member. The operator actuatable means includes a cover plate, and a lever movable between advance and retard positions.

FIG. 2 is a partial, enlarged, top view of the engine with each of the flywheel and the timing member partially cut away.

FIG. 3 is a side elevational view of the portion of the engine shown in FIG. 2.

FIG. 9 is a perspective view of the lever.

Figure 4:
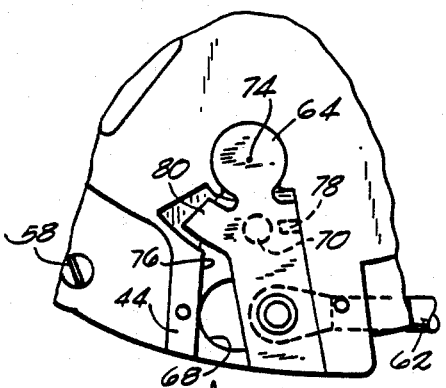
FIG. 4 is a partial top view similar to FIG. 2 with the cover plate removed and with the lever in the advance position.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 which embodies various of the features of the invention is illustrated in the drawings. As best shown in FIG. 1, the marine propulsion device 10 comprises a mounting assembly 12 mounted on the transom 14 of a boat. In the preferred embodiment, the mounting assembly 12 includes a transom bracket 16 fixedly mounted on the transom 14, and a swivel bracket 18 mounted on the transom bracket 16 for pivotal movement relative thereto about a generally horizontal tilt axis 20. The marine propulsion device 10 also comprises a propulsion unit 22 mounted on the swivel bracket 18 for pivotal movement relative thereto about a generally vertical steering axis 24, and for common movement therewith about the tilt axis 20.

The propulsion unit 22 includes a rotatably mounted propeller 26, and an internal combustion engine 28 drivingly connected to the propeller 26 by a conventional drive train 30. The engine 28 includes an engine block 32 (FIG. 3), and a crankshaft 34 (FIG. 2) supported by the engine block 32 for rotation relative thereto about a crankshaft axis 36. The engine 28 also includes a flywheel 37 mounted on the upper end of the crankshaft 34 for rotation therewith, and a conventional carburetor 38 including a throttle plate 40 mounted on a throttle shaft 42. Means (not shown) are provided for biasing the throttle plate 40 toward the closed position.

The engine 28 further includes a timing member or plate 44 mounted on the engine block 32 for movement relative thereto in opposite advance and retard directions for respectively advancing and retarding the spark timing of the engine 28. In the preferred embodiment, the timing member 44 is mounted, by a suitable bearing 45 (FIG. 2), on the engine block 32 and beneath the flywheel 37 for rotation about the crankshaft axis 36. In FIG. 2, the advance and retard directions are respectively counterclockwise and clockwise.

The engine 28 further includes means for moving the throttle plate 40 toward the open position in response to movement of the timing member 44 in the advance direction. While various suitable means can be employed, in the preferred embodiment, such means includes (see FIGS. 2 and 3) a throttle cam 56 fixedly mounted on the timing member 44 by suitable means such as screws 58 (see FIG. 2), and a throttle cam roller 60 operably connected to the throttle shaft 42 and engaging the throttle cam 56 for moving the throttle shaft 42 in response to movement of the throttle cam 56. Such an arrangement is disclosed in U.S. Soder Pat. No. 2,906,251, issued Sept. 29, 1959, which is incorporated herein by reference.

The force biasing the throttle plate 40 toward the closed position acts through the throttle cam roller 60 and the throttle cam 56 to exert on the timing member 44 a torque biasing the timing member 44 in the retard direction. Failure to counter this torque may allow the throttle plate 40 to close during engine operation.

In order to prevent undesired movement of the timing member 44 in the retard direction during engine operation, the engine 28 further includes releasable locking means for preventing movement of the timing member 44 in one of the advance and retard directions. In the preferred embodiment, wherein the timing member 44 is biased in the retard direction, the locking means prevents movement of the timing member 44 in the retard direction.

Figure 7:
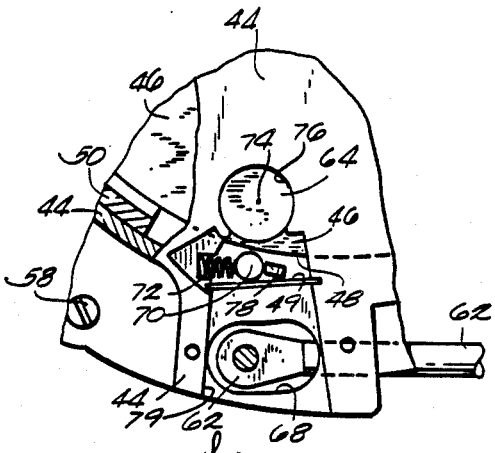
FIG. 7 is a view similar to FIG. 5 with the lever removed.
Figure 8:
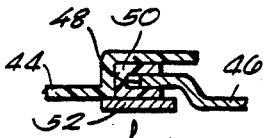
FIG. 8 is a cross-sectional view taken along line 8—8 in FIG. 2.

While various suitable locking means can be used, in the illustrated construction, the locking means includes a generally circular plate 46 centered on the crankshaft axis 36 and fixedly mounted on the engine block 32. The plate 46 includes an arcuate outer or first surface 48 forming a circle centered on the crankshaft axis 36. In order to maintain alignment of the plate 46 and the timing member 44 in the direction of the crankshaft axis 36, the engine 28 also includes (see FIGS. 2, 7 and 8) a partially annular bearing member 50 with a generally C-shaped cross-section slideably mounted on the periphery of the support plate 46. Because the bearing member 50 is partially annular, a portion of the outer surface of the plate 46 is exposed, for reasons explained hereinafter. The engine 28 also includes a support ring 52 mounted on the underside of the timing member 44 so that the bearing member 50 is sandwiched between the support ring 52 and the timing member 44, as shown in FIG. 8. Thus, the bearing member 50 moves with the timing member 44 and support ring 52 relative to the plate 46. Any suitable means such as screws 54 (see FIG. 2) can be used for mounting the support ring 52 on the timing member 44.

The locking means also includes, on the timing member 44, a second surface 49 (see FIGS. 6 and 7) closely spaced from the exposed portion of the outer surface 48 on the plate 46 with the surfaces 48 and 49 converging in the advance direction. In the illustrated construction, the surface 49 is provided by a metal plate 51 (see FIG. 6) mounted on the timing member 44.

The locking means also includes a roller 70 located between the first and second surfaces 48 and 49, and means biasing the roller 70 in the advance direction (to the right in FIGS. 4–7) relative to the first and second surfaces 48 and 49 for wedging the roller 70 between the first and second surfaces 48 and 49 so as to prevent movement of the timing member 44 in the retard direction (to the left in FIGS. 4–7). While various suitable means can be employed for biasing the roller 70, in the illustrated construction, such means includes (see FIGS. 6 and 7) a spring 72 located between the timing member 44 and the roller 70.

The engine 28 further includes operator actuatable means for releasing the locking means and moving the timing member 44 in the retard direction, and for moving the timing member 44 in the advance direction.

While various suitable operator actuatable means can be employed, in the preferred embodiment, the operator actuatable means includes an operator actuatable mechanism movable in opposite first and second directions. In the preferred embodiment, the operator actuatable mechanism is a push-pull cable 62. The operator actuatable means also includes means operable on the timing member 44 for moving the timing member 44 in the advance direction in response to movement of the mechanism or cable 62 in the first direction, and for releasing the locking means and moving the timing member 44 in the retard direction in response to movement of the mechanism or cable 62 in the second direction. In the preferred embodiment, the means operable on the timing member 44 is operable for moving the timing member 44 to any position within a continuous range of positions. In other words, the timing member 44 is locatable in an infinite number of positions within its range of movement, as opposed to being locatable in a finite number of discrete positions.

While various suitable means operable on the timing member 44 can be used, in the illustrated construction, the means operable on the timing member 44 includes (see FIGS. 3–5 and 9) a lever 64 movably mounted on the timing member 44. In the preferred embodiment, the lever 64 is mounted on the timing member 44 for rotation about an axis 74 (see FIGS. 4–7). More particularly, the timing member 44 has, in its upper surface, a recess 76 having opposite walls 77 and 79 and including a circular portion centered on the axis 74. The lever 64 is movably seated in the recess 76 and has a generally circular end located in the circular portion of the recess 76 so as to permit rotation of the lever 64 about the axis 74. The lever 64 extends generally radially outwardly (relative to the crankshaft axis 36) from the axis 74, and the walls 77 and 79 of the recess 76 limit movement of the lever 64 between an advance position (FIG. 4) wherein the lever 64 engages the right wall 77 and a retard position (FIG. 5) wherein the lever 64 engages the left wall 79.

The means operable on the timing member 44 also includes means for releasing the locking means and causing movement of the timing member 44 in the retard direction in response to movement of the lever 64 in the retard direction, and for causing movement of the timing member 44 in the advance direction in response to movement of the lever 64 in the advance direction. While various suitable releasing and moving means can be employed, in the preferred embodiment, the releasing and moving means includes means for moving the roller 70, in response to movement of the lever 64 in the retard direction relative to the timing member 44, in the retard direction against the force of the biasing means and relative to the first and second surfaces 48 and 49 so as to permit movement of the timing member 44 in the retard direction.

While various suitable means can be used for moving the roller 70, in the illustrated construction, such means includes, on the lever 64, a projection 78 (FIGS. 4–7 and 9) extending downwardly between the first and second surfaces 48 and 49 and adjacent the roller 70. As best shown in FIGS. 6 and 7, the projection 78 is located in the advance direction (to the right) relative to the roller 70. When the lever 64 is in the advance position (FIGS. 4 and 6), the projection 78 is out of engagement with the roller 70 so that the spring 72 wedges the roller 70 between the first and second surfaces 48 and 49. When the lever 64 is moved from the advance position toward the retard position (FIGS. 5 and 7), the projection 78 engages the roller 70 and moves the roller 70 in the retard direction and against the force of the spring 72 so that the roller 70 is not wedged between the first and second surfaces 48 and 49. This permits movement of the timing member 44 in the retard direction.

The means operable in the timing member 44 also includes means connecting the lever 64 to the cable 62 for causing movement of the lever 64 in the advance direction in response to movement of the cable 62 in the first direction, and for causing movement of the lever 64 in the retard direction in response to movement of the cable 62 in the second direction. In the preferred embodiment, the first and second directions are respectively the same as the advance and retard directions, and the means connecting the lever 64 to the cable 62 causes common movement of the lever 64 and the cable 62. Specifically, in the preferred embodiment, the cable 62 is connected to the lever 64 by a connecting link 66 (see FIGS. 3 and 9) which extends through an opening 68 (see FIGS. 4–7) in the timing member 44. Preferably, the cable 62 is connected to the lever 64 at a point spaced from the axis 74, or is connected to the outer end of the lever 64. Thus, movement of the outer end of the lever 64 in the advance and retard directions causes rotation of the lever 64 about the axis 74.

Figure 5:
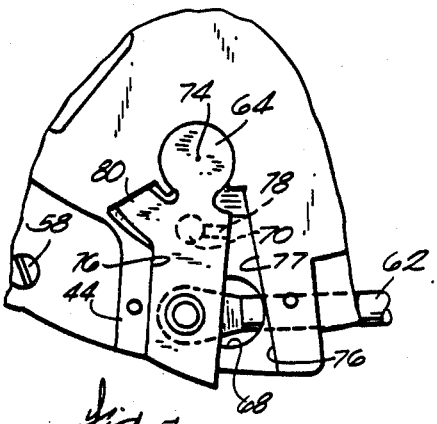
FIG. 5 is a view similar to FIG. 4 with the lever in the retard position.
Figure 6:
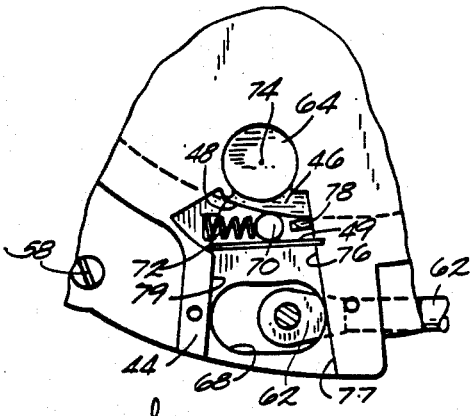
FIG. 6 is a view similar to FIG. 4 with the lever removed.

In the illustrated construction, as best shown in FIGS. 4 and 5, the projection 78 is located between the axis 74 and the point of connection of the cable 62 to the lever 64, so that the force necessary to move the outer end of the lever 64 is less than the force necessary to overcome the force of the spring 72. In other words, the arrangement provides a mechanical advantage, and the operator needs to exert very little force on the push-pull cable 62 in order to overcome the spring force.

In the preferred embodiment, the lever 64 includes an integral tab 80 (FIGS. 4, 5 and 9) which extends above the spring 72 to trap the spring 72 between the lever 64 and the timing member 44. Furthermore, a cover plate 82 (FIGS. 2 and 3) is provided for securing the lever 64 in the recess 76 while allowing movement of the lever 64 within the recess 76. The cover plate 82 is secured to the timing member 44 by suitable means such as screws 84 (FIG. 2).

The spark control arrangement functions as follows. When no force is being exerted on the cable 62 by the operator, the lever 64 exerts no force on the roller 70, and the spring 72 wedges the roller 70 between the first and second surfaces 48 and 49. Because the plate 46, which includes the first surface 48, is fixed relative to the engine block 32, this wedging action prevents movement of the timing member 44 in the retard direction. When the operator moves the cable 62 in the advance direction (to the right), the cable 62 moves the lever 64 in the advance direction, and the lever 64 engages the wall 77 of the recess 76 (FIG. 4) and thereby moves the timing member 44 in the advance direction. Because the first and second surfaces 48 and 49 converge in the advance direction, the first surface 48 "moves away from" the roller 70 when the timing member 44 moves in the advance direction, and the roller 70 does not prevent movement of the timing member 44 in the advance direction. When the operator moves the cable 62 in the retard direction (to the left), the cable 62 moves the lever 64 in the retard direction relative to the timing member 44 (see FIG. 5). The initial movement of the lever 64 acts through the projection 78 to move the roller 70 in the retard direction relative to the first and second surfaces 48 and 49. Because the roller 70 is prevented by the projection 78 from becoming wedged between the first and second surfaces 48 and 49, this permits movement of the timing member 44 in the retard direction. After the initial movement of the lever 64, the timing member 44 moves with the lever 64 in the retard direction.

Depending upon the strength of the spring 72, the lever 64 may or may not engage the wall 79 before the timing member 44 begins to move with the lever 64 in the retard direction. More particularly, if the torque exerted on the lever 64 by the spring 72 is greater than the torque necessary to move the timing member 44 once the locking means is released, the timing member 44 will move before the spring 72 is completely compressed and the lever 64 engages the wall 79.

Various features of the invention are set forth in the following claims:

We claim:

1. A marine propulsion device comprising a mounting assembly adapted to be mounted on the transom of a boat, and a propulsion unit mounted on said mounting assembly for pivotal movement relative thereto about a generally vertical steering axis, said propulsion unit including a rotatably mounted propeller, and an internal combustion engine drivingly connected to said propeller, said engine comprising an engine block, a timing member mounted on said engine block for movement relative thereto in opposite advance and retard directions for respectviely advancing and retarding the spark timing of said engine, releasable locking means on said engine block and on said timing member for preventing movement of said timing member in only one of said directions, and operator actuatable means for releasing said locking means and moving said timing member in said one direction, and for movement said timing member in the other of said directions.

2. A marine propulsion device as set for in claim 1 wherein said operator actuatable means is operable for moving said timing member to any position within a continuous range of positions.

3. A marine propulsion device as set forth in claim 1 wherein said one direction is said retard direction.

4. A marine propulsion device as set forth in claim 3 wherein said operator actuatable means includes an operator actuatable mechanism movable in opposite first and second directions, and means operable on said timing member for moving said timing member in said advance direction in response to movement of said mechanism in said first direction, and for releasing said locking means and moving said timing member in said retard direction in response to movement of said mechanism in said second direction.

5. A marine propulsion device as set forth in claim 4 wherein said means operable on said timing member is operable for moving said timing member to any position within a continuous range of positions.

6. A marine propulsion device as set forth in claim 4 wherein said means operable on said timing member includes a lever movably mounted on said timing member, means for releasing said locking means and causing movement of said timing member in said retard direction in response to movement of said lever in said retard direction, and for causing movement of said timing member in said advance direction in response to movement of said lever in said advance direction, and means connecting said lever to said mechanism for causing movement of said lever in said advance direction in response to movement of said mechanism in said first direction, and for causing movement of said lever in said retard direction in response to movement of said mechanism in said second direction.

7. A marine propulsion device as set forth in claim 6 wherein said first and second directions are respectively the same as said advance and retard directions, and wherein said means connecting said lever to said mechanism causes common movement of said lever and said mechanism.

8. A marine propulsion device as set forth in claim 7 wherein said mechanism is a push-pull cable.

9. A marine propulsion device as set forth in claim 6 and further comprising a first surface fixed relative to said engine block and extending in said advance and retard directions, wherein said timing member includes a second surface closely spaced from said first surface with said first and second surfaces converging in said advance direction, and wherein said locking means includes said first and second surfaces, a roller located between said first and second surfaces, and means biasing said roller in said advance direction relative to said first and second surfaces for wedging said roller between said first and second surfaces so as to prevent movement of said timing member in said retard direction.

10. A marine propulsion device as set forth in claim 9 wherein said releasing means includes means for moving said roller, in response to movement of said lever in said retard direction relative to said timing member, in said retard direction against the force of said biasing means and relative to said first and second surfaces so as to permit movement of said timing member in said retard direction.

11. A marine propulsion device as set forth in claim 10 wherein said lever is mounted on said timing member for rotation relative thereto about an axis, wherein said mechanism is connected to said lever at a point spaced from said axis, wherein said means biasing said roller in said advance direction exerts a force on said roller, and wherein said means for moving said roller includes, on said lever, a projection located intermediate said point and said axis, whereby the force required from said mechanism to move said lever in said retard direction relative to said timing member is less than the force exerted by said biasing means.

12. A marine propulsion device as set forth in claim 9 wherein said timing member is mounted on said engine block for rotation about an axis, wherein said advance and retard directions are opposite directions of rotation about said axis, wherein said engine further comprises a plate fixedly mounted on said engine block, said plate including an arcuate outer surface forming at least part of a circle centered on said axis, wherein said first surface is said arcuate surface, and wherein said second surface is spaced radially outwardly of said first surface.

13. A marine propulsion device as set forth in claim 1 wherein said timing member is mounted on said engine block for rotation about an axis, and wherein said advance and retard directions are opposite directions of rotation about said axis.

14. An internal combustion engine comprising an engine block, a timing member mounted on said engine block for movement relative thereto in opposite advance and retard directions for respectively advancing and retarding the spark timing of said engine, releasable locking means on said engine block and on said timing member for preventing movement of said timing member in only one of said directions, and operator actuatable means for releasing said locking means and moving said timing member in said one direction, and for moving said timing member in the other of said directions.

15. An engine as set forth in claim 14 wherein said operator actuatable means is operable for moving said timing member to any position within a continuous range of positions.

16. An engine as set forth in claim 14 wherein said one direction is said retard direction.

17. An engine as set forth in claim 16 wherein said operator actuatable means includes an operator actuatable mechanism movable in opposite first and second directions, and means operable on said timing member for moving said timing member in said advance direction in response to movement of said mechanism in said first direction, and for releasing said locking means and moving said timing member in said retard direction in response to movement of said mechanism in said second direction.

18. An engine as set forth in claim 17 wherein said means operable on said timing member is operable for moving said timing member to any position within a continuous range of positions.

19. An engine as set forth in claim 17 wherein said means operable on said timing member includes a lever movably mounted on said timing member, means for releasing said locking means and causing movement of said timing member in said retard direction in response to movement of said lever in said retard direction, and for causing movement of said timing member in said advance direction in response to movement of said lever in said advance direction, and means connecting said lever to said mechanism for causing movement of said lever in said advance direction in response to movement of said mechanism in said first direction, and for causing movement of said lever in said retard direction in response to movement of said mechanism in said second direction.

20. An engine as set forth in claim 19 wherein said first and second directions are respectively the same as said advance and retard directions, and wherein said means connecting said lever to said mechanism causes common movement of said lever and said mechanism.

21. An engine as set forth in claim 20 wherein said mechanism is a push-pull cable.

22. An engine as set forth in claim 19 and further comprising a first surface fixed relative to said engine block and extending in said advance and retard directions, wherein said timing member includes a second surface closely spaced from said first surface with said first and second surfaces converging in said advance direction, and wherein said locking means includes said first and second surfaces, a roller located between said first and second surfaces, and means biasing said roller in said advance direction relative to said first and second surfaces for wedging said roller between said first and second surfaces so as to prevent movement of said timing member in said retard direction.

23. An engine as set forth in claim 22 wherein said releasing means includes means for moving said roller, in response to movement of said lever in said retard direction relative to said timing member, in said retard direction against the force of said biasing means and relative to said first and second surfaces so as to permit movement of said timing member in said retard direction.

24. An engine as set forth in claim 23 wherein said lever is mounted on said timing member for rotation relative thereto about an axis, wherein said mechanism is connected to said lever at a point spaced from said axis, wherein said means biasing said roller in said advance direction exerts a force on said roller, and wherein said means for moving said roller includes, on said lever, a projection located intermediate said point and said axis, whereby the force required from said mechanism to move said lever in said retard direction relative to said timing member is less than the force exerted by said biasing means.

25. An engine as set forth in claim 22 wherein said timing member is mounted on said engine block for rotation about an axis, wherein said advance and retard directions are opposite directions of rotation about said axis, wherein said engine further comprises a plate fixedly mounted on said engine block, said plate including an arcuate outer surface forming at least part of a circle centered on said axis, wherein said first surface is said arcuate surface, and wherein said second surface is spaced radially outwardly of said first surface.

26. An engine as set forth in claim 14 wherein said timing member is mounted on said engine block for rotation about an axis, and wherein said advance and retard directions are opposite directions of rotation about said axis.

27. A marine propulsion device comprising a mounting assembly adapted to be mounted on the transom of a boat, and a propulsion unit mounted on said mounting assembly for pivotal movement relative thereto about a generally vertical steering axis, said propulsion unit including a rotatably mounted propeller, and an internal combustion engine drivingly connected to said propeller, said engine comprising an engine block, a plate fixedly mounted on said engine block, said plate including an arcuate first surface forming at least part of a circle centered on an axis, a timing member mounted on said engine block for rotation relative thereto about said axis in opposite advance and retard directions for respectively advancing and retarding the spark timing of said engine, said timing member including a second surface closely spaced from said first surface and spaced radially outwardly of said first surface, with said first and second surfaces converging in said advance direction, an operator actuatable push-pull cable movable in opposite first and second directions, a lever movably mounted on said timing member, a roller located between said first and second surfaces, means biasing said roller in said advance direction relative to said first and second surfaces for wedging said roller between said first and second surfaces so as to prevent movement of said timing member in said retard direction, means for moving said roller, in response to movement of said lever in said retard direction relative to said timing member, in said retard direction against the force of said biasing means and relative to said first and second surfaces so as to permit movement of said timing member in said retard direction, and means connecting said lever to said cable for causing movement of said lever in said advance direction in response to movement of said cable in said first direction, and for causing movement of said lever in said retard direction in response to movement of said cable in said second direction.

28. A marine propulsion device as set forth in claim 27 wherein said first and second directions are respectively the same as said advance and retard directions, and wherein said means connecting said lever to said push-pull cable causes common movement of said lever and said push-pull cable.

29. A marine propulsion device comprising a mounting assembly adapted to be mounted on the transom of a boat, and a propulsion unit mounted on said mounting assembly for pivotal movement relative thereto about a generally vertical steering axis, said propulsion unit including a rotatably mounted propeller, and an internal combustion engine drivingly connected to said propeller, said engine comprising an engine block, a timing member mounted on said engine block for movement relative thereto in opposite advance and retard directions for respectively advancing and retarding the spark timing of said engine, releasable locking means for preventing movement of said timing member in one of said directions, and operator actuatable means for releasing said locking means and moving said timing member in said one direction, and for moving said timing member in the other of said directions, said operator actuatable means including an operator actuatable push-pull cable movable in opposite first and second directions, and means operable on said timing member for moving said timing member in said advance direction in response to movement of said push-pull cable in said first direction, and for releasing said locking means and moving said timing member in said retard direction in response to movement of said push-pull cable in said second direction.

30. A marine propulsion device as set forth in claim 29 wherein said means operable on said timing member is operable for moving said timing member to any position within a continuous range of positions.

31. A marine propulsion device as set forth in claim 29 wherein said means operable on said timing member includes a lever movably mounted on said timing member, means for releasing said locking means and causing movement of said timing member in said retard direction in response to movement of said lever in said retard direction, and for causing movement of said timing member in said advance direction in response to movement of said lever in said advance direction, and means connecting said lever to said push-pull cable for causing movement of said lever in said advance direction in response to movement of said push-pull cable in said first direction, and for causing movement of said lever in said retard direction in response to movement of said push-pull cable in said second direction.

32. A marine propulsion device as set forth in claim 31 wherein said first and second directions are respectively the same as said advance and retard directions, and wherein said means connecting said lever to said push-pull cable causes common movement of said lever and said push-pull cable.

33. A marine propulsion device as set forth in claim 31 and further comprising a first surface fixed relative to said engine block and extending in said advance and retard directions, wherein said timing member includes a second surface closely spaced from said first surface with said first and second surfaces converging in said advance direction, and wherein said locking means includes said first and second surfaces, a roller located between said first and second surfaces, and means biasing said roller in said advance direction relative to said first and second surfaces for wedging said roller between said first and second surfaces so as to prevent movement of said timing member in said retard direction.

34. A marine propulsion device as set forth in claim 33 wherein said releasing means includes means for moving said roller, in response to movement of said lever in said retard direction relative to said timing member, in said retard direction against the force of said biasing means and relative to said first and second surfaces so as to permit movement of said timing member in said retard direction.

35. A marine propulsion device as set forth in claim 34 wherein said lever is mounted on said timing member for rotation relative thereto about an axis, wherein said push-pull cable is connected to said lever at a point spaced from said axis, wherein said means biasing said roller in said advance direction exerts a force on said roller, and wherein said means for moving said roller includes, on said lever, a projection located intermediate said point and said axis, whereby the force required from said push-pull cable to move said lever in said retard direction relative to said timing member is less than the force exerted by said biasing means.

36. A marine propulsion device as set forth in claim 31 wherein said timing member is mounted on said engine block for rotation about an axis, wherein said advance and retard directions are opposite directions of rotation about said axis, wherein said engine further comprises a plate fixedly mounted on said engine block, said plate including an arcuate outer surface forming at least part of a circle centered on said axis, wherein said first surface is said arcuate surface, and wherein said second surface is spaced radially outwardly of said first surface.

37. An internal combustion engine comprising an engine block, a timing member mounted on said engine block for movement relative thereto in opposite advance and retard directions for respectively advancing and retarding the spark timing of said engine, releasable locking means for preventing movement of said timing member in one of said directions, and operator actuatable means for releasing said locking means and moving said timing member in said one direction, and for moving said timing member in the other of said directions, said operator actuatable means including an operator actuatable push-pull cable movable in opposite first and second directions, and means operable in said timing member for moving said timing member in said advance direction in response to movement of said push-pull cable in said first direction, and for releasing said locking means and moving said timing member in said retard direction in response to movement of said push-pull cable in said second direction.

38. An engine as set forth in claim 37 wherein said means operable in said timing member is operable for moving said timing member to any position within a continuous range of positions.

39. An engine as set forth in claim 37 wherein said means operable on said timing member includes a lever movably mounted on said timing member, means for releasing said locking means and causing movement of said timing member in said retard direction in response to movement of said lever in said retard direction, and for causing movement of said timing member in said advance direction in response to movement of said lever in said advance direction, and means connecting said lever to said push-pull cable for causing movement of said lever in said advance direction in response to movement of said push-pull cable in said first direction, and for causing movement of said lever in said retard direction in response to movement of said push-pull cable in said second direction.

40. An engine as set forth in claim 39 wherein said first and second directions are respectively the same as said advance and retard directions, and wherein said means connecting said lever to said push-pull cable causes common movement of said lever and said push-pull cable.

41. An engine as set forth in claim 39 and further comprising a first surface fixed relative to said engine block and extending in said advance and retard directions, wherein said timing member includes a second surface closely spaced from said first surface with said first and second surfaces converging in said advance direction, and wherein said locking means includes said first and second surfaces, a roller located between said first and second surfaces, and means biasing said roller in said advance direction relative to said first and second surfaces for wedging said roller between said first and second surfaces so as to prevent movement of said timing member in said retard direction.

42. An engine as set forth in claim 40 wherein said releasing means includes means for moving said roller, in response to movement of said lever in said retard direction relative to said timing member, in said retard direction against the force of said biasing means and relative to said first and second surfaces so as to permit movement of said timing member in said retard direction.

43. An engine as set forth in claim 42 wherein said lever is mounted on said timing member for rotation relative thereto about an axis, wherein said push-pull cable is connected to said lever at a point spaced from said axis, wherein said means biasing said roller in said advance direction exerts a force on said roller, and wherein said means for moving said roller includes, on said lever, a projection located intermediate said point and said axis, whereby the force required from said push-pull cable to move said lever in said retard direction relative to said timing member is less than the force exerted by said biasing means.

44. An engine as set forth in claim 41 wherein said timing member is mounted on said engine block for rotation about an axis, wherein said advance and retard directions are opposite directions of rotation about said axis, wherein said engine further comprises a plate fixedly mounted on said engine block, said plate including an arcuate outer surface forming at least part of a circle centered on said axis, wherein said first surface is said arcuate surface, and wherein said second surface is spaced radially outwardly of said first surface.

* * * * *